US006070025A

United States Patent [19]

Jeong

[11] Patent Number: 6,070,025

[45] Date of Patent: May 30, 2000

[54] TECHNIQUE FOR CONTROLLING TRANSFER VOLTAGE IN AN IMAGE FORMING APPARATUS IN ACCORDANCE WITH DETECTED COMPOSITE RESISTANCE BETWEEN PHOTOCONDUCTIVE DRUM AND TRANSFER ROLLER

[75] Inventor: Su-Jong Jeong, Kyongsangbuk-do, Rep. of Korea

[73] Assignee: SamSung Electronics Co., Ltd., Suwon, Rep. of Korea

[21] Appl. No.: 09/285,462

[22] Filed: Apr. 2, 1999

[30] Foreign Application Priority Data

Jun. 1, 1998 [KR] Rep. of Korea ..... 98-20258

[51] Int. Cl.[7] ..... G03G 15/16

[52] U.S. Cl. ..... 399/66

[58] Field of Search ..... 399/45, 48, 66, 399/313, 318

[56] References Cited

U.S. PATENT DOCUMENTS 5,151,736 9/1992 Ohzeki et al. .
5,287,144 2/1994 Takeda .
5,621,509 4/1997 Karashima et al. ..... 399/66 X
5,682,575 10/1997 Komori .
5,774,762 6/1998 Takemoto et al. .
5,799,225 8/1998 Abe et al. .
5,799,226 8/1998 Shigeta et al. .
5,822,651 10/1998 Yim et al. .
5,848,321 12/1998 Roh et al. .
5,903,798 5/1999 Yokogawa et al. ..... 399/66
5,905,925 5/1999 Kawabata et al. ..... 399/45
5,909,605 6/1999 Nishizawa et al. ..... 399/66

*Primary Examiner*—Susan S. Y. Lee
*Attorney, Agent, or Firm*—Robert E. Bushnell, Esq.

[57] ABSTRACT

An image forming apparatus reads a composite resistance of an OPC drum and a transfer roller before a sheet of recording paper has advanced between the OPC drum and the transfer roller to provide a proper transfer voltage. To this end, the apparatus provides a first transfer voltage to the transfer roller to detect a composite resistance between the OPC drum and the transfer roller, before the recording paper has advanced between the OPC drum and the transfer roller. When the leading edge of the recording paper has arrived between the OPC drum and the transfer roller, the apparatus provides the transfer roller with a second transfer voltage in accordance with the detected composite resistance. Further, a composite resistance of the OPC drum, the transfer roller and the recording paper is detected after the second transfer voltage is supplied to the transfer roller. The transfer roller is then provided with a third transfer voltage in accordance with the detected composite resistance of the OPC drum, the transfer roller and the recording paper.

24 Claims, 7 Drawing Sheets

| COMPOSITE RESISTANCE | 3RD TRANSFER VOLTAGE |
|---|---|
| R<80MΩ | 600V |
| 80≤R<90MΩ | 700V |
| 90≤R<100MΩ | 800V |
| 100MΩ≤R<110MΩ | 900V |
| 110MΩ≤R<120MΩ | 1000V |
| 120MΩ≤R<130MΩ | 1100V |
| 130MΩ≤R<140MΩ | 1200V |
| 140MΩ≤R<150MΩ | 1300V |
| 150MΩ≤R<160MΩ | 1400V |
| 160MΩ≤R<170MΩ | 1500V |
| 170MΩ≤R<180MΩ | 1600V |

FIG. 5A

| COMPOSITE RESISTANCE | 3RD TRANSFER VOLTAGE |
|---|---|
| R<200MΩ | 1000V |
| 200M≦R<225MΩ | 1100V |
| 225M≦R<250MΩ | 1200V |
| 250M≦R<275MΩ | 1300V |
| ⋮ | ⋮ |
| 400M≦R<500MΩ | 1900V |

FIG. 5B

| COMPOSITE RESISTANCE | 3RD TRANSFER VOLTAGE |
|---|---|
| R<400MΩ | 1600V |
| 400M≦R<450MΩ | 1700V |
| 450M≦R<500MΩ | 1800V |
| 500M≦R<550MΩ | 1900V |
| ⋮ | ⋮ |
| 1000MΩ≦R | 2900V |

FIG. 5C

TECHNIQUE FOR CONTROLLING TRANSFER VOLTAGE IN AN IMAGE FORMING APPARATUS IN ACCORDANCE WITH DETECTED COMPOSITE RESISTANCE BETWEEN PHOTOCONDUCTIVE DRUM AND TRANSFER ROLLER

CLAIM OF PRIORITY

This application makes reference to, incorporates the same herein, and claims all benefits accruing under 35 U.S.C. §119 from an application for METHOD FOR CONTROLLING TRANSFER VOLTAGE IN IMAGE FORMING APPARATUS earlier filed in the Korean Industrial Property Office on the Jun. 1, 1998 and there duly assigned Ser. No. 20258/1998.

BACKGROUND OF THE INVENTION

1. Field of the Invention

The present invention relates to technique for controlling a transfer voltage in an image forming apparatus, and in particular, to a technique for detecting a composite resistance between an organic photo conductive (OPC) drum and a transfer roller before a sheet of recording paper advances between the OPC drum and the transfer roller, so as to control a transfer voltage according to the detected composite resistance.

2. Description of the Related Art

In general, an image forming apparatus charges a photoconductive layer of an OPC drum made of a photosemiconductor such as zinc oxide or selenium, exposes the photoconductive layer according to an image signal to form an electrostatic latent image, develops the electrostatic latent image with a toner, and then transfers the developed toner image to the recording paper. The image forming apparatus employs a contact-charging technique, which is widely used to minimize generation of ozone due to charging by bring a conductive roller or brush serving as a contact charging device into contact with the OPC drum to form a uniform surface charge on the OPC drum. The image forming apparatus supplies a proper transfer voltage to a transfer roller in order to transfer the toner developed on the OPC drum to the recording paper without degradation of the image.

U.S. Pat. No. 5,682,575 to Komori, entitled ELECTROPHOTOGRAPHIC RECORDING APPARATUS HAVING TRANSFER VOLTAGE CONTROL DEVICE, discloses a technique for controlling the transfer voltage by detecting a resistance of the transfer roller when a leading end of the recording paper passes the transfer roller. In this transfer voltage control technique, a transfer voltage is determined when the leading end (≈5 mm) of the recording paper, which is a non-image formative area, passes between the OPC drum and the transfer roller, in accordance with a composite resistance of the recording paper, the OPC drum and the transfer roller. However, this technique reads the composite resistance only at the leading end, i.e., the non-image formative area of the recording paper, so that this technique may not be suitable for a high speed image forming apparatus. That is, in a high speed laser printer, the non-image formative area advances too fast to read an accurate composite resistance, decreasing the transfer efficiency. Moreover, a voltage used for reading the composite resistance may be supplied even to an image formative area undesirably, resulting in the image degradation due to the decreased transfer efficiency.

U.S. Pat. No. 5,799,226 to Shigeta et al., entitled ELECTROSTATIC IMAGE FORMING APPARATUS WITH TRANSFER CONTROLS FOR DIFFERENT IMAGING MODES, discloses an imaging forming apparatus having various transfer and attraction voltages in which the transfer voltage is varied in accordance with the type of transfer paper.

The patent to Takemoto et al., U.S. Pat. No. 5,774,762, entitled IMAGE FORMING APPARATUS FOR OPTIMIZING TONER TRANSFER EFFICIENCY, discloses an image forming apparatus for optimizing the toner transfer efficiency in which the resistance of the transfer material is detected and the transfer voltage controlled in accordance with the resistance of the transfer material.

The patent to Takeda, U.S. Pat. No. 5,287,144, entitled IMAGE FORMING APPARATUS HAVING TRANSFER CHARGER WHICH IS CONTROLLED ACCORDING TO AMBIENT CONDITIONS, discloses an image forming apparatus having a transfer charger which is controlled according to ambient conditions. The transfer current is varied in accordance with the resistance of the transfer material when the transfer material passes between the contact member and a transfer material carrying sheet.

The following patent each discloses features in common with the present invention but are not as pertinent as the patents discussed above: U.S. Pat. No. 5,799,225 to Abe et al., entitled IMAGE FORMING APPARATUS HAVING VARIABLE TRANSFER AND ATTRACTION VOLTAGE, U.S. Pat. No. 5,822,651 to Yim et al., entitled TRANSFER VOLTAGE ADJUSTING DEVICE, U.S. Pat. No. 5,151,736 to Ohzeki et al., entitled IMAGE FORMING APPARATUS WITH CONTROLLED TRANSFER VOLTAGE, and U.S. Pat. No. 5,848,321 to Roh et al., entitled METHOD FOR AUTOMATICALLY CONTROLLING TRANSFER VOLTAGE IN PRINTER USING ELECTROPHOTOGRAPHY SYSTEM.

SUMMARY OF THE INVENTION

It is therefore an object of the present invention to provide a transfer voltage control technique for reading a composite resistance of an OPC drum and a transfer roller before a sheet of recording paper has advanced between the OPC drum and the transfer roller to provide a proper transfer voltage in a high speed image forming apparatus.

To achieve the above object, there is provided a technique for controlling a transfer voltage in an image forming apparatus in which a first transfer voltage is provided to a transfer roller to detect a composite resistance between an OPC drum and the transfer roller, before the recording paper has advanced between the OPC drum and the transfer roller. The transfer roller is then provided with a second transfer voltage in accordance with the detected composite resistance, when a leading edge of the recording paper arrives between OPC drum and the transfer roller.

Further, a composite resistance of the OPC drum, the transfer roller and the recording paper is detected after the second transfer voltage is supplied to the transfer roller. The transfer roller is then provided with a third transfer voltage in accordance with the detected composite resistance of the OPC drum, the transfer roller and the recording paper.

Preferably, the first transfer voltage is 800V, and the second transfer voltage is 800V, 1300V or 1800V according to the detected composite resistance of the OPC drum and the transfer roller. Further, the third transfer voltage is a voltage selected between 600V and 3000V according to the composite resistance of the OPC drum, the transfer roller and the recording paper.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIGS. 5A to 5C are tables showing the transfer voltages corresponding to detected composite resistance values.

DETAILED DESCRIPTION OF THE PREFERRED EMBODIMENT

A preferred embodiment of the present invention will be described hereinbelow with reference to the accompanying drawings. In the following description, well known functions or constructions are not described in detail since they would obscure the invention in unnecessary detail.

Figure 1:
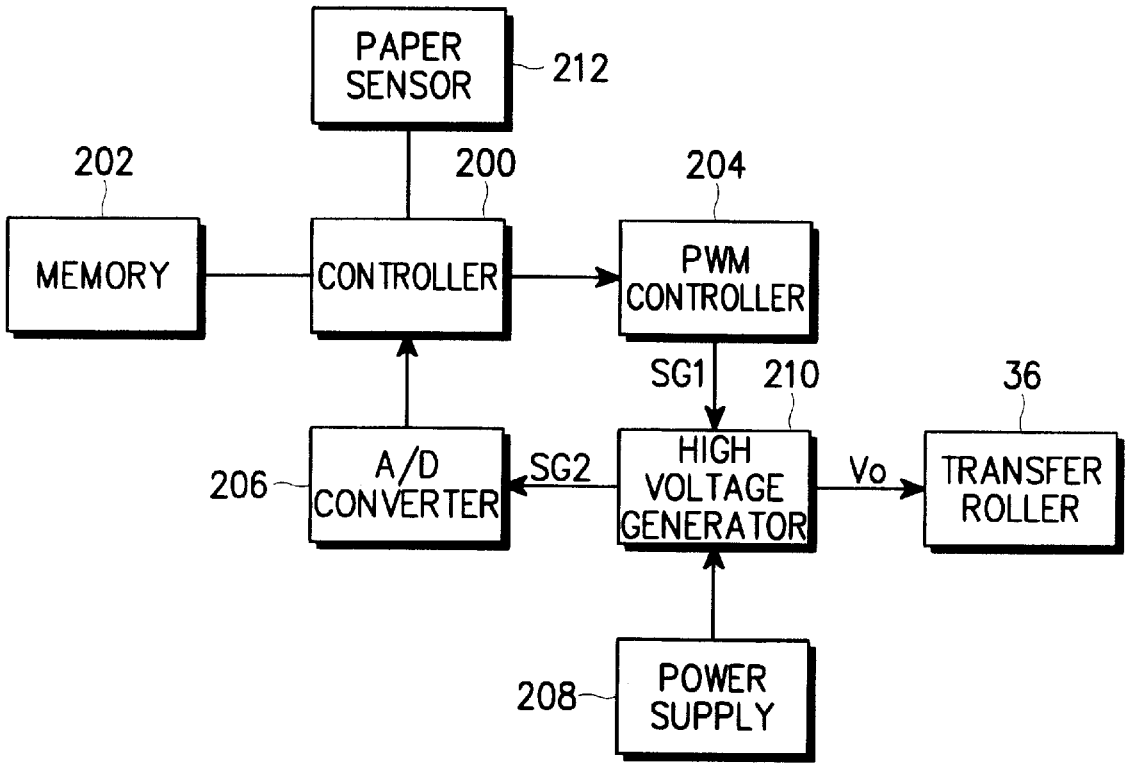
FIG. 1 is a block diagram of an image forming apparatus to which the present invention applicable.

FIG. 1 illustrates a block diagram of an image forming apparatus to which the present invention is applied. In FIG. 1, a controller 200 controls an overall operation for recording an image on the recording paper, and reads a composite resistance of the recording paper, an OPC drum 33 (see FIG. 3) and a transfer roller 36 to generate a PWM (Pulse Width Modulation) control signal for controlling the transfer voltage. A memory 202 is composed of a ROM (Read Only Memory) for storing a control program and a RAM (Random Access Memory) for temporarily storing a voltage value for detecting the composite resistance. A WPM controller 204 outputs a PWM signal SG1 according to the PWM control signal generated from the controller 200. A power supply 208 receives an AC input voltage and outputs voltages of different levels. A high voltage generator 210 provided with a voltage input from the power supply 208, generates a transfer voltage Vo corresponding to the PWM signal SG1 output from the PWM controller 204 to provide the transfer voltage Vo to the transfer roller 36, and provides an analog-to-digital (A/D) converter 206 with a voltage SG2 for detecting the composite resistance of the transfer roller 36 when the transfer voltage Vo is supplied to the transfer roller 36. The A/D converter 206 converts the voltage SG2 to a digital signal and provides it to the controller 200. A paper sensor 212 senses that a leading edge of the recording paper has advanced between the OPC drum 33 and the transfer roller 36 and provides the sensing result to the controller 200.

Figure 2:
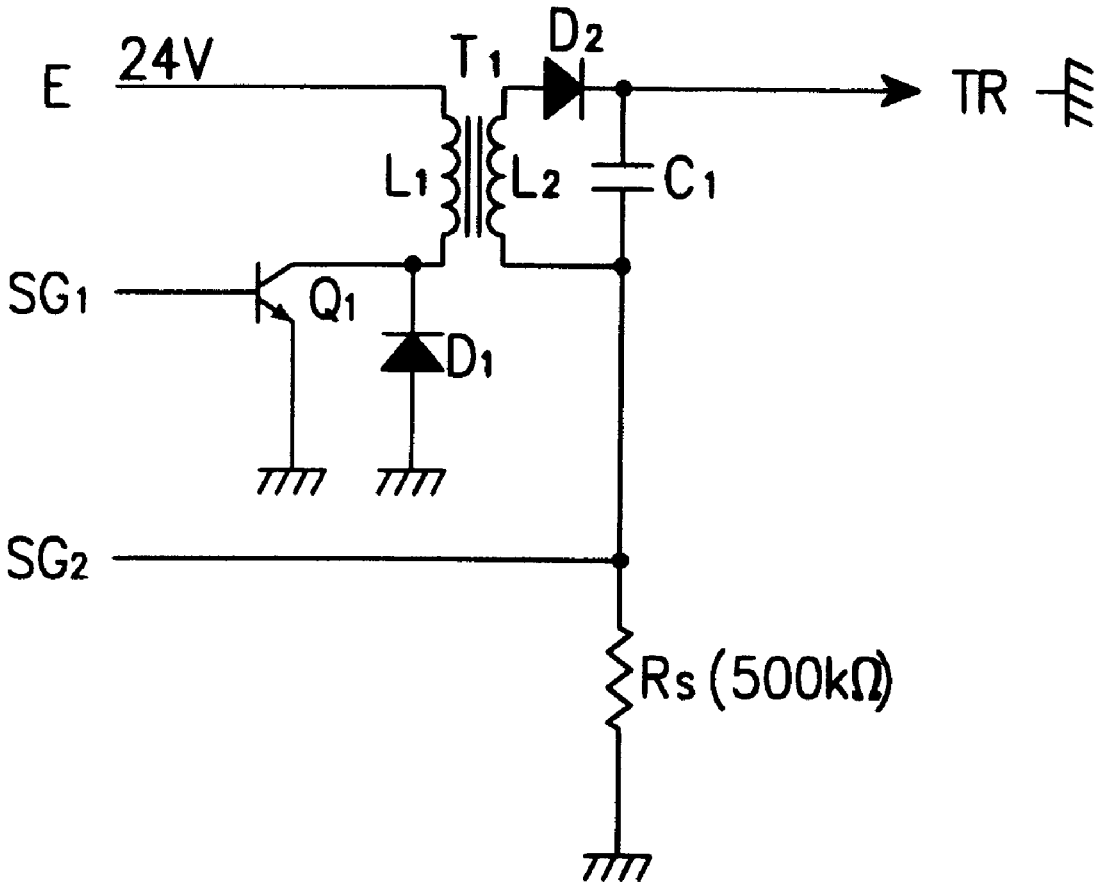
FIG. 2 is a detailed circuit diagram of the high voltage generator (210) of FIG. 1.

FIG. 2 illustrates a circuit diagram of the high voltage generator 210. As illustrated, a transformer T1 has a primary winding L1 provided with a voltage 24V from the power supply 208, and has a secondary winding L2 having a larger number of turns than that of the primary winding L1 so that a voltage at the secondary winding L2 is higher than the voltage at the primary winding L1. A diode D1 connected between the primary winding L1 and ground, clips the voltage being induced from the primary winding L1 to the secondary winding L2. A transistor Q1 has a base receiving the PWM signal SG1 output from the PWM controller 204, a collector connected to the primary winding L1, and an emitter connected to ground. The transistor Q1 is switched according to the PWM signal SG1 so that the voltage at the primary winding L1 is induced in the secondary winding L2. A rectifying diode D2 with an anode connected to the secondary winding L2, rectifies the voltage induced in the secondary winding L2. A smoothing capacitor C1 smooths the voltage rectified by the rectifying diode D2 and provides the transfer roller (TR) 36 with the smoothed voltage as the transfer voltage Vo. A resistor Rs, connected between the secondary winding L2 and ground, detects a current flowing in the transfer roller 36. The voltage SG2 for detecting the composite resistance, supplied to the A/D converter 206, is varied according to the current flowing in the resistor Rs.

Figure 3:
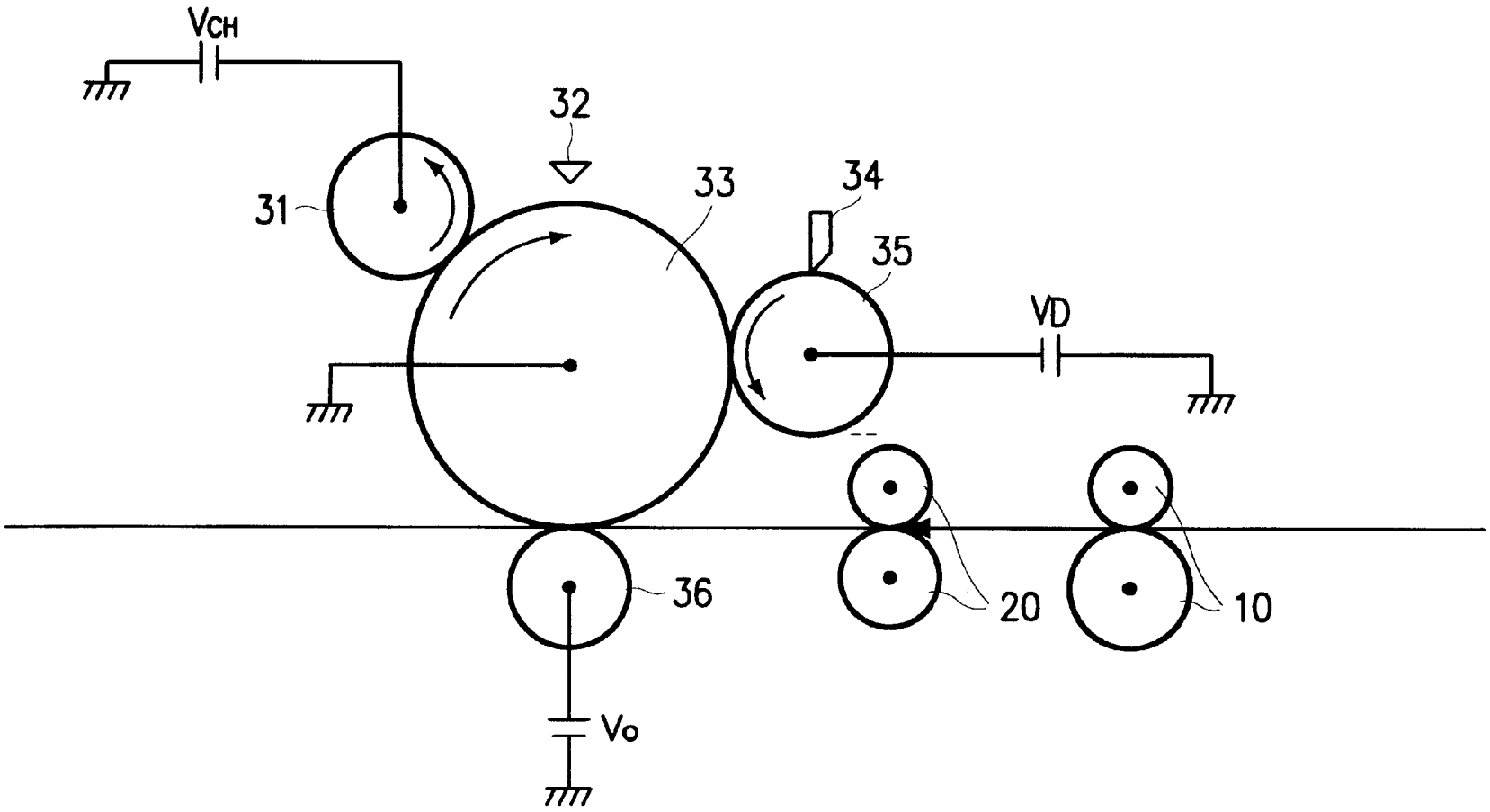
FIG. 3 is a schematic diagram of a printer engine of the image forming apparatus, for explaining a transferring process according to an embodiment of the present invention.

FIG. 3 illustrates a printer engine of the image forming apparatus, to explain the transferring process according to an embodiment of the present invention. In FIG. 3, the OPC drum 33 rotates in an arrow direction by an engine driving motor (not shown), a main motor, of the printer engine in accordance with the respective process of an electrophotographic processor. A conductive roller 31, a contact charging device, charges the surface of the photosensitive OPC drum 33 with a uniform electric charge. The conductive roller 31 has a negative potential due to a negative charge voltage $V_{CH}$. The OPC drum 33 is charged by contacting the conductive roller 31 and thus has a negative surface potential. Commonly, the surface potential of the OPC drum 33 is about −800V. By exposing the charged OPC drum 33 according to a document or image data, an electrostatic latent image is formed on the OPC drum 33. Here, only an image area for printing is exposed by using an exposure unit 32. Then, a unexposed area maintains the charged surface potential while the exposed area has a potential changed, forming the electrostatic latent image having the potential difference between the unexposed area and the exposed area. Conveying rollers 10 convey the recording paper fed from a paper cassette (not shown) to register rollers 20. The register rollers 20 align the leading edge of the recording paper conveyed along a conveying path. The aligned recording paper is conveyed to the transfer roller 36 along the conveying path. The electrostatic latent image formed on the OPC drum 33 is converted to a visible image by the toner. A developing roller 35 is commonly provided with a developing voltage $V_D$ of about −450V, thus having a negative potential, so that the toner is attached to the developing roller 35. The toner attached to the developing roller 35 is regulated by a regulation blade 34 so that the developing roller 35 is uniformly covered with the toner. Thereafter, the toner of the negative potential moved to the developing roller 36 is partially attached to the exposed area on the OPC drum 33, performing the developing process. The toner attached to the OPC drum 33 in the developing process, is transferred to the conveyed recording paper when the transfer voltage Vo is supplied to the transfer roller 36. At this moment, the composite resistance between the OPC drum 33 and the transfer roller 36 is detected by supplying, for example, a voltage 800V to the transfer roller 36 during an interval where the first recording paper is about to advance between the OPC drum 33 and the transfer roller 36. Then, one of the voltages of, for example, 800V, 1300V and 1800V corresponding to the composite resistance is supplied to the transfer roller 36. Subsequently, when the leading edge of the recording paper has advanced between the OPC drum 33 and the transfer roller 36, the composite resistance between the OPC drum 33 and the transfer roller 36 is detected and then, the transfer voltage Vo corresponding to the detected composite resistance is supplied to the transfer roller 36 to transfer the toner to the recording paper, based on the tables shown in FIGS. 5A to 5C.

Figure 4:
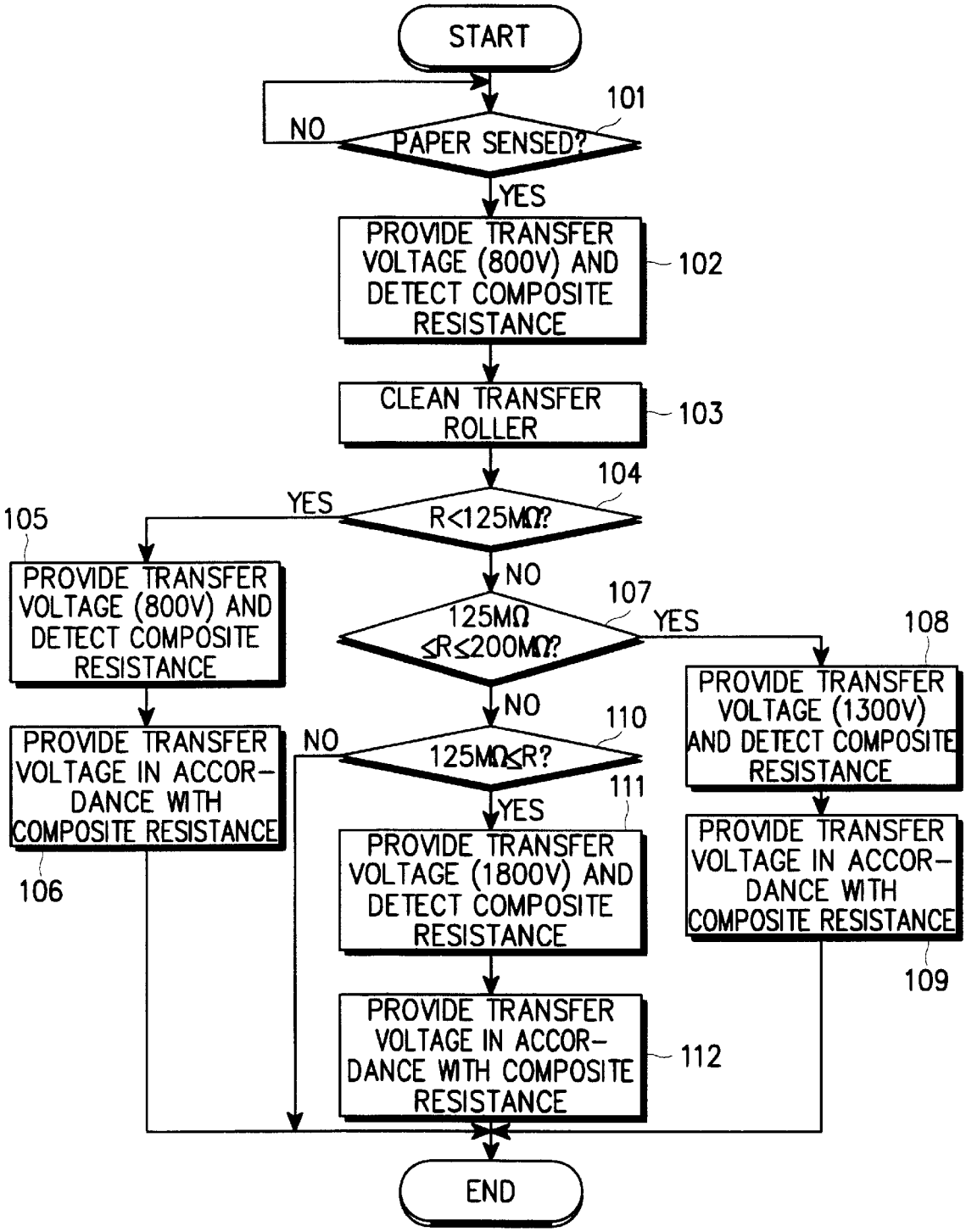
FIG. 4 is a flowchart illustrating the controlling of a transfer voltage according to an embodiment of the present invention.

FIG. 4 is a flowchart for controlling the transfer voltage Vo according to the present invention, and FIGS. 5A to 5C are tables showing the transfer voltages corresponding to the detected composite resistance values.

Now, referring to FIGS. 1 to 5C, the preferred embodiment of the present invention will be described in detail. Upon reception of the paper sensing signal from the paper sensor 212, the controller 200 generates the PWM control signal and drives the PWM controller 204. The PWM controller 204 then provides the PWM signal SG1 to the high voltage generator 210 to switch on/off the transistor Q1. As the transistor Q1 is switched on/off, the voltage at the primary winding L1 of the transformer T1 is induced in the secondary winding L2 according to a winding ratio of the primary winding L1 to the secondary winding L2, generating the high voltage. The high voltage induced in the secondary winding L2 is rectified by the rectifying diode D2 and the capacitor C1 and then supplied to the transfer roller 36. The controller 200 then generates the PWM control signal to control a duty cycle of the PWM signal SG2, in order to vary the high voltage supplied to the transfer roller 36.

When the transfer voltage from the high voltage generator 210 is supplied to the transfer roller 36, the current flowing in the transfer roller 36 is identical to the current flowing in the resistor Rs. Therefore, it is possible to detect the composite resistance between the OPC drum 33 and the transfer roller 36 by detecting the current flowing in the resistor Rs. For example, assuming that the voltage $V_{TR}$ supplied to the transfer roller 36 is 800V, the resistor Rs has a resistance 500KΩ and the voltage $V_{SG2}$ for detecting the composite resistance is 3V, the current $I_{RS}$ flowing in the resistor Rs is given by $$I_{RS} = \frac{V_{SG2}}{R_S} = \frac{3}{500\times10^5} = 6\times10^{-6} = 6\mu A \quad (1)$$

Since the current $I_{RS}$ is identical to the current $I_{TR}$ flowing in the transfer roller 36, the resistance $R_{TR}$ of the transfer roller 36 is $$R_{TS} = \frac{V_{TR}}{I_{TR}} = \frac{800}{6\times10^{-6}} = 133\times10^6 = 133M\Omega \quad (2)$$

Therefore, in accordance with the table shown in FIG. 5A, a third transfer voltage 1200V corresponding to the resistance $R_{TR}$ of 133MΩ is supplied to the transfer roller 36. Now, referring to FIG. 4, the controller 200 determines in step 101 whether the paper sensing signal is received from the paper sensor 212. Upon reception of the paper sensing signal, the controller 200 controls the PWM controller 204 in step 102 to provide a first transfer voltage of, for example, 800V before the recording paper has advanced between the OPC drum 33 and the transfer roller 36, to thereby determine the composite resistance of the OPC drum 33 and the transfer roller 36 in accordance with equations (1) and (2). The composite resistance between the OPC drum 33 and the transfer roller 36 in the state where the recording paper does not advance therebetween, may depend on the surroundings such as the internal temperature and humidity. Subsequently, in step 103, the controller 200 cleans the transfer roller 36 by transferring the toner on the transfer roller 36 to the OPC drum 33 using the first transfer voltage 800V before the arrival of the recording paper.

More specifically, in the cleaning process, the surface potential of the OPC drum 33 in contact with the transfer roller 36, is about −650V to −700V, when the OPC drum 33 is charged with the charge voltage −800V. At this moment, if a positive voltage is supplied to the transfer roller 36, the positive toner attached to the surface of the transfer roller 36 is moved to the OPC drum 33 by the potential difference. Since the positive voltage supplied for cleaning the transfer roller 36 is changed according to the resistance of the transfer roller 36, a cleaning voltage is determined according to the resistance measured at the first transfer voltage, as shown in the following Table 1.

TABLE 1

| Resistance of Transfer Roller | Cleaning Voltage |
|---|---|
| below 100MΩ | +500V |
| 150MΩ | +700V |
| 200MΩ | +900V |
| 250MΩ | +1100V |
| 300MΩ | +1200V |
| 400M⅝ | +1300V |
| 500MΩ | +1400V |
| over 500MΩ | +1500V |

After cleaning the transfer roller 36, if it is determined in step 104 that the composite resistance R is below 125MΩ, in step 105 the controller 200 controls the PWM controller 204 to supply a second transfer voltage of, for example, 800V to the transfer roller 36 and then detects the composite resistance between the OPC drum 33 and the transfer roller 36. In the high speed printer, the transferring process is performed for the partial image area by this voltage 800V. After that, in step 106, the controller 200 provides a third transfer voltage corresponding to the composite resistance determined in step 105, based on the table shown in FIG. 5A. If, for example, the detected composite resistance is below 80MΩ, the third transfer voltage is 600V.

However, if the detected composite R is equal to or higher than 125MΩ in step 104, the controller 200 determines in step 107 whether 125MΩ≦R≦200MΩ. If so, the controller 200 controls the PWM controller 204 in step 108 to supply the second transfer voltage of, for example, 1300V to the transfer roller 36 and then detects the composite resistance between the OPC drum 33 and the transfer roller 36. In the high speed printer, the transferring process is performed for the partial image area by this voltage 1300V. After that, in step 109, the controller 200 provides a third transfer voltage corresponding to the composite resistance determined in step 108, based on the table shown in FIG. 5B. If, for example, the detected composite resistance is below 200MΩ, the third transfer voltage is 1000V.

However, if the detected composite R is higher than 200MΩ in step 107, the controller 200 determines in step 110 whether 200MΩ<R. If so, the controller 200 controls the PWM controller 204 in step 111 to supply the second transfer voltage of, for example, 1800V to the transfer roller 36 and then detects the composite resistance between the OPC drum 33 and the transfer roller 36. In the high speed printer, the transferring process is performed for the partial image area by this voltage 1800V. After that, in step 112, the controller 200 provides a third transfer voltage corresponding to the composite resistance determined in step 111, based on the table shown in FIG. 5C. If, for example, the detected composite resistance is below 400MΩ, the third transfer voltage is 1600V.

As described above, the transfer voltage of 800, 1300 or 1800V is supplied to the transfer roller 36 according to the composite resistance detected between the OPC drum 33 and the transfer roller 36 before the recording paper arrives therebetween. Accordingly, in high speed printing, the composite resistance determining process and the transferring process are simultaneously performed while the leading edge (8 mm) of the recording paper passes between the OPC drum 33 and the transfer roller 36. In this manner, the low transfer efficiency problem can be prevented at the leading portion of the recording paper. The paper sensor 24, not described herein, is composed of a plurality of sensing elements for sensing the feeding of the recording paper, and senses the state where recording paper has advanced between the OPC drum 33 and the transfer roller 36.

In addition, it can be appreciated that the composite resistance of the OPC drum 33 and the transfer roller 36 can be calculated from equations (1) and (2) by reading the voltage $V_{SG2}$ for the second transfer voltage through the A/D converter 206. However, this method may have a problem, if the recording paper arrives late between the OPC drum 33 and the transfer roller 36 at the time when the second transfer voltage is supplied, or if the recording paper arrives between the OPC drum 33 and the transfer roller 36 without registration. That is, even though there is no recording paper between the OPC drum 33 and the transfer roller 36, the apparatus misrecognizes that the recording paper exists therebetween. In this case, the apparatus may output a low third transfer voltage, under a judgement that the recording paper has a very low resistance. To solve this problem, after supplying the second transfer voltage, the apparatus reads the voltage $V_{SG2}$ several times, for example, four times and compares the read values each time in the following manner. That is, the apparatus compares the firstly read value with the secondly read value and takes, if the difference between the resistances for these values is over 30MΩ, the secondly read value, discarding the firstly read value. Again, the apparatus compares the secondly read value with the thirdly read value and takes, if the resistance difference therebetween is over 30MΩ, the thirdly read value, discarding the secondly read value. In the event that the resistance differences among all the four values are over 30MΩ, an average value of the four read values is recognized as the composite resistance between the OPC drum 33 and the transfer roller 36. Here, the reason that the differences among the values read each time are over 30MΩ is because the recording paper has not arrived between the OPC drum 33 and the transfer roller 36. In this manner, the apparatus can prevent misrecognition of the composite resistance, when the recording paper arrives late between the OPC drum 33 and the transfer roller 36 or arrives being unregistered.

In sum, the apparatus reads the composite resistance just before the recording paper advances between the OPC drum and the transfer roller and provides the transfer roller with the transfer voltage corresponding to the read composite resistance, so that it is possible to perform a process for reading the composite resistance of the OPC drum, the transfer roller and the recording paper, together with the transferring process. Accordingly, in high speed printing, misrecognition of the composite resistance at the non image area can be prevented.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A method of controlling a transfer voltage in an image forming apparatus, comprising the steps of:

providing a first transfer voltage to a transfer roller to detect a composite resistance between an organic photoconductive (OPC) drum and the transfer roller, before recording paper has advanced between the OPC drum and the transfer roller; and providing the transfer roller with a second transfer voltage solely in accordance with the detected composite resistance, upon a leading edge of the recording paper arriving between OPC drum and the transfer roller.

2. The method as claimed in claim 1, further comprising the steps of:

detecting a composite resistance of the OPC drum, the transfer roller and the recording paper, after providing the second transfer voltage to the transfer roller; and providing the transfer roller with a third transfer voltage in accordance with the detected composite resistance of the OPC drum, the transfer roller and the recording paper.

3. The method as claimed in claim 1, the first transfer voltage being 800V.

4. The method as claimed in claim 2, the first transfer voltage being 800V.

5. The method as claimed in claim 1, the second transfer voltage being one of 800V, 1300V or 1800V in accordance with the detected composite resistance of the OPC drum and the transfer roller.

6. The method as claimed in claim 2, the second transfer voltage being one of 800V, 1300V or 1800V in accordance with the detected composite resistance of the OPC drum and the transfer roller.

7. The method as claimed in claim 3, the second transfer voltage being one of 800V, 1300V or 1800V in accordance with the detected composite resistance of the OPC drum and the transfer roller.

8. The method as claimed in claim 2, the third transfer voltage being a voltage in a range of from 600V to 3000V in accordance with the composite resistance of the OPC drum, the transfer roller and the recording paper.

9. The method as claimed in claim 4, the third transfer voltage being a voltage in a range of from 600V to 3000V in accordance with the composite resistance of the OPC drum, the transfer roller and the recording paper.

10. The method as claimed in claim 6, the third transfer voltage being a voltage in a range of from 600V to 3000V in accordance with the composite resistance of the OPC drum, the transfer roller and the recording paper.

11. A method of controlling a transfer voltage in an image forming apparatus, comprising the steps of:

providing a first transfer voltage of 800V to a transfer roller to detect a composite resistance between an OPC drum and the transfer roller, before recording paper has advanced between the OPC drum and the transfer roller;

providing a second transfer voltage of 800V to the transfer roller upon a leading edge of the recording paper arriving between the OPC drum and the transfer roller, upon a composite resistance between the OPC drum and the transfer roller being below 125MΩ;

providing a second transfer voltage of 1300V to the transfer roller upon the leading edge of the recording paper arriving between the OPC drum and the transfer roller, upon the composite resistance being between 125MΩ and 200MΩ; and providing a second transfer voltage of 1800V to the transfer roller upon the leading edge of the recording paper arriving between the OPC drum and the transfer roller, upon the composite resistance being higher than 200MΩ.

12. The method as claimed in claim 11, further comprising the steps of:

detecting a composite resistance of the OPC drum, the transfer roller and the recording paper, after providing the second transfer voltage to the transfer roller; and providing the transfer roller with a third transfer voltage in accordance with the detected composite resistance of the OPC drum, the transfer roller and the recording paper.

13. An apparatus for controlling a transfer voltage in an image forming apparatus, comprising the steps of:

a means for providing a first transfer voltage to a transfer roller to detect a composite resistance between an organic photoconductive (OPC) drum and the transfer roller, before recording paper has advanced between the OPC drum and the transfer roller; and a means for providing the transfer roller with a second transfer voltage solely in accordance with the detected composite resistance, upon a leading edge of the recording paper arriving between OPC drum and the transfer roller.

14. The apparatus as claimed in claim 13, further comprising:

a means for detecting a composite resistance of the OPC drum, the transfer roller and the recording paper, after providing the second transfer voltage to the transfer roller; and a means for providing the transfer roller with a third transfer voltage in accordance with the detected composite resistance of the OPC drum, the transfer roller and the recording paper.

15. The apparatus as claimed in claim 13, the first transfer voltage being 800V.

16. The apparatus as claimed in claim 14, the first transfer voltage being 800V.

17. The apparatus as claimed in claim 13, the second transfer voltage being one of 800V, 1300V or 1800V in accordance with the detected composite resistance of the OPC drum and the transfer roller.

18. The apparatus as claimed in claim 14, the second transfer voltage being one of 800V, 1300V or 1800V in accordance with the detected composite resistance of the OPC drum and the transfer roller.

19. The apparatus as claimed in claim 15, the second transfer voltage being one of 800V, 1300V or 1800V in accordance with the detected composite resistance of the OPC drum and the transfer roller.

20. The apparatus as claimed in claim 14, the third transfer voltage being a voltage in a range of from 600V to 3000V in accordance with the composite resistance of the OPC drum, the transfer roller and the recording paper.

21. The apparatus as claimed in claim 16, the third transfer voltage being a voltage in a range of from 600V to 3000V in accordance with the composite resistance of the OPC drum, the transfer roller and the recording paper.

22. The apparatus as claimed in claim 18, the third transfer voltage being a voltage in a range of from 600V to 3000V in accordance with the composite resistance of the OPC drum, the transfer roller and the recording paper.

23. A method of controlling a transfer voltage in an image forming apparatus, comprising the steps of:

providing a first transfer voltage of a first value to a transfer roller to detect a composite resistance between a drum and the transfer roller, before recording paper has advanced between the drum and the transfer roller;

providing a second transfer voltage of a first value to the transfer roller upon a leading edge of the recording paper arriving between the drum and the transfer roller, upon a composite resistance between the drum and the transfer roller being below of a first value;

providing a second transfer voltage of a second value to the transfer roller upon the leading edge of the recording paper arriving between the drum and the transfer roller, upon the composite resistance being between the first value and a second value; and providing a second transfer voltage of a third value to the transfer roller upon the leading edge of the recording paper arriving between the drum and the transfer roller, upon the composite resistance being higher than the second value.

24. The method as claimed in claim 23, further comprising the steps of:

detecting a composite resistance of the drum, the transfer roller and the recording paper, after providing the second transfer voltage to the transfer roller; and providing the transfer roller with a third transfer voltage in accordance with the detected composite resistance of the drum, the transfer roller and the recording paper.

* * * * *